United States Patent [19]

Vinciguerra

[11] Patent Number: 4,842,271

[45] Date of Patent: Jun. 27, 1989

[54] LEG EXTENSION EXERCISE MACHINE WITH LEG LENGTH AND EXERCISE MOTION RANGE ADJUSTMENT APPARATUS

[75] Inventor: John D. Vinciguerra, Dallas, Tex.

[73] Assignee: Nautilus Sports/Medical Industries, Inc., Dallas, Tex.

[21] Appl. No.: 198,132

[22] Filed: May 24, 1988

[51] Int. Cl.[4] ..... A63B 21/06

[52] U.S. Cl. ..... 272/118; 272/134; 272/145

[58] Field of Search ..... 272/117, 118, 129, 130, 272/132, 134, 136, 142, 145; 128/25 R, 70–75

[56] References Cited

U.S. PATENT DOCUMENTS

| | | | |
|---|---|---|---|
| 3,858,873 | 1/1975 | Jones | 272/58 |
| 4,232,662 | 11/1980 | Barber | 128/71 |
| 4,367,731 | 1/1983 | Barber | 128/71 |
| 4,462,252 | 7/1984 | Smidt et al. | 272/134 X |
| 4,478,411 | 10/1984 | Baldwin | 272/118 |
| 4,493,485 | 1/1985 | Jones | 272/126 |
| 4,500,089 | 2/1985 | Jones | 272/118 X |
| 4,511,137 | 4/1985 | Jones | 272/118 |
| 4,542,899 | 9/1985 | Hendricks | 272/118 |
| 4,624,458 | 11/1986 | Fendrik | 128/75 X |
| 4,628,910 | 12/1986 | Krukowski | 128/25 R |
| 4,669,724 | 6/1987 | Matheisen | 272/145 |
| 4,691,694 | 9/1987 | Boyd et al. | 128/25 R |
| 4,691,919 | 9/1987 | Roberson | 272/145 |
| 4,717,148 | 1/1988 | Brewer | 272/145 |
| 4,753,126 | 6/1988 | Sammaratano | 372/134 X |
| 4,763,897 | 8/1988 | Yakata | 272/118 |
| 4,772,015 | 9/1988 | Carlson et al. | 272/129 X |

OTHER PUBLICATIONS

Advertisement by Eagle Fitness Systems; Received in PTO—Aug. 24, 1987.

*Primary Examiner*—Richard J. Apley
*Assistant Examiner*—Robert W. Bahr
*Attorney, Agent, or Firm*—Hubbard, Thurman, Turner & Tucker

[57] ABSTRACT

The pivotally mounted force input lever of a leg extension exerciser machine is connected by a chain, sprocket and cam system to a multi-element weight stack such that leg-driven pivotal motion of the lever may be resisted by a selectively variable portion of the weight stack. A counterbalanced foot engagement structure is pivotally secured to the outer end of the lever, and the lever is rotationally counterbalanced by a counterweight secured to its opposite end. User leg length adjustment of the machine is effected by pivotally adjusting the foot engagement structure relative to the lever, without shifting the center of gravity of the foot engagement structure, to thereby avoid disturbance of the rotational balance of the input lever. A resisted motion range adjustment mechanism is incorporated in the machine and is operative to selectively vary the weight-resisted angular start setting of the lever without altering the angular position relationship between the force input lever and the machine cam. A position gauge is used to continuously provide a visual indication of the angular position of the input lever within its overall motion range.

12 Claims, 3 Drawing Sheets

LEG EXTENSION EXERCISE MACHINE WITH LEG LENGTH AND EXERCISE MOTION RANGE ADJUSTMENT APPARATUS

BACKGROUND OF THE INVENTION

The present invention relates generally to exercise machines and, in a preferred embodiment thereof, more particularly provides a leg extension exercise machine having improved leg length and exercise motion range adjustment mechanisms incorporated therein to facilitate the operation of the machine by exercisers utilizing rehabilitative leg exercise programs.

Leg extension exercise machines are well known in the exercise machine art and typically comprise a seat structure carried by a support frame to which is pivotlly mounted a leg force input lever. Via a sprocket, chain and cam linking system, the force input lever is operatively connected to a multi-element weight stack carried by the support frame, a selectively variable portion of the weight stack being operatively connectable to an outer end of the linking system to yieldingly resist leg-driven pivotal motion of the input member.

To use such a machine, the exerciser sits in the machine seat, with his legs extending downwardly over the front edge thereof, and hooks his feet under padded foot engagement members secured to the outer end of the force input lever. By extending his legs toward their straightened positions, the lever is pivoted against the resistive force of the selected portion of the weight stack as it is lifted from the balance of the weight stack. When the legs have been extended to a desired degree, they are slowly lowered against the pivotal resistance of the weight stack portion as it is lowered to its start position.

While leg exercise machines of this general type are widely used and are quite beneficial to able bodied exercisers, their use has, in the past, has been somewhat limited as to exercisers attempting to use the machines for rehabilitative exercise purposes following, for example, knee or leg surgery. In such instances of rehabilitative machine use, the exerciser is typically limited to relatively low resistive weight loads and/or is further limited as to the angular range through which he may safely move the force input lever against the resistance of the predetermined portion of the weight stack. For example, the exerciser using the machine in a rehabilitative leg exercise routine may only be permitted to subject his legs to pivotal weight resistance within a small portion of the overall available pivotal range of the force input member.

Various proposals have been made to accommodate leg extension exercise machines of this general type to limited rehabilitative use thereof. For example, various mechanisms have been proposed to selectively limit the weight-resisted angular range of the force input lever. However, conventional approaches to this angular limitation have typically necessitated either an undesirable variance in the angular relationship between the input lever and the machine cam, or required that the input lever be pivoted against the resistance of the weight stack to effect such angular range adjustment.

Another problem associated with attempts to utilize machines of this type in limited, rehabilitative leg exercise programs is associated with the height adjustment of the foot engagement structure carried by the force input lever. Specifically, to adjust the actual foot engagement portion of such structure to accommodate exerciser leg length variances, the center of gravity of the foot engagement structure has heretofore been unavoidably shifted, thereby disturbing the rotational balance of the input lever provided by its associated counterweight. Particularly when the exerciser in a rehabilitative exercise program is limited to using a very small portion of the weight stack, this shifting of the foot engagement structure center of gravity significantly alters the leg force required to pivot the lever for varying leg lengths. At the very low weight resistance levels involved in such rehabilitative exercise program this is a decidedly undesirably result.

From the foregoing it can readily be seen that improvements are needed in leg exercise machines of this general type in order to better facilitate their use in rehabilitative leg exercise programs. It is accordingly an object of the present invention to provide a leg extension exercise machine in which such improvements are advantageously incorporated.

SUMMARY OF THE INVENTION

In carrying out principles of the present invention, in accordance with a preferred embodiment thereof, a leg extension exercise machine of the general type previously described herein is provided with an improved exercise motion adjustment mechanism which is operative to selectively alter the weight-resisted "start" position of the force input lever without requiring that the important relationship between the input lever angular position and the machine cam angular position be altered, or requiring that the input lever be pivoted against the resistance of any portion of the weight stack to vary the effective weight-resisted lever start position. Additionally, an improved foot engagement structure is provided which may be height adjusted to accommodate exerciser leg length variances without shifting the center of gravity of such foot engagement structure, thereby maintaining the rotational balance of the force input lever provided by its associated counterweight.

The foot engagement structure is pivotally secured to an outer end portion of the lever member and has a foot engagement portion engageable by the legs of the seated exerciser, generally adjacent his feet, in a manner such that extension of the exerciser's legs pivotally drives the lever member in a first rotational direction about its pivot axis, the weight of the foot engagement structure passing through a center of gravity thereof and exerting a first torque on the lever member in a second direction about its pivot axis, such first torque being counterbalanced by the counter weight associated with the lever member. Adjustment means are provided for pivotally adjusting the foot engagement structure relative to the outer end portion of the lever member in a manner selectively varying the height of the foot engagement portion relative to the outer end portion of the lever member to compensate for exerciser leg length variances without shifting the center of gravity of the foot engagement structure relative to the outer lever end portion. Because leg lengths adjustment of the foot engagement structure does not shift its center of gravity, leg length adjustments may be made to the foot engagement structure without rotationally imbalancing the lever member about its pivot axis.

The motion adjustment mechanism comprises an elongated strap member secured to the weight stack end of the linking system, roller means carried by the uppermost weight stack element and secured to the free end of the strap, the roller means being rotatable in opposite directions to selectively roll up the strap to tension it and operatively associate the selected portion of the weight stack and the lever member, or to permit payout of the strap relative to the weight stack to permit the lever member to be pivoted toward its outer limit position without resistance from the selected weight stack portion. Locking means are provided for selectively locking the strap to the uppermost weight element or unlocking the strap and permitting payout thereof relative to the uppermost weight element.

In this manner, the resisted pivotal starting point of the lever member within its overall pivotal motion range may be shifted from its normal pivotal start position to a preselected intermediate pivotal position within its motion range by unlocking the locking means with the lever member in its normal pivotal start position to operatively disassociate the lever member from the weight stack, moving the lever member from its normal start position to the selected intermediate position to cause strap payout relative to the weight stack, and then relocking the locking means to operatively reassociate the lever member with the selected portion of the weight stack.

For use in conjunction with the motion adjustment mechanism, gauge means are provided for continuously providing a visual readout indicative of the position of the lever member within its overall pivotal motion range. Accordingly, an exerciser in a rehabilitative leg exerciser program requiring that he use the machine only within an intermediate portion of its available weight-resisted pivotal input lever motion range may do so simply by appropriately adjusting the weight-resisted start position of the lever as previously described, watching the gauge means to determine when he has reached the prescribed angular leg extension limit, and then terminating leg extension and allowing his legs to return to their start position. In this manner, the exerciser may safely and conveniently use the machine within the prescribed limited angular motion range thereof.

While the start position adjustment mechanism in a preferred embodiment thereof is representatively incorporated in the weight stack of a leg exercise machine, it will be readily appreciated that it could also be incorporated in the weight stacks of a variety of other exercise machines of this general type used to exercise and strengthen other portions of the body. The range adjustment of the force input portions of such alternate machines would be effected in the same manner as just described, and similar gauge means could be utilized to provide a visual indication of the position in the overall force input member movement range to which such member has been moved during performance of a given exercise routine.

DETAILED DESCRIPTION

Figure 1:
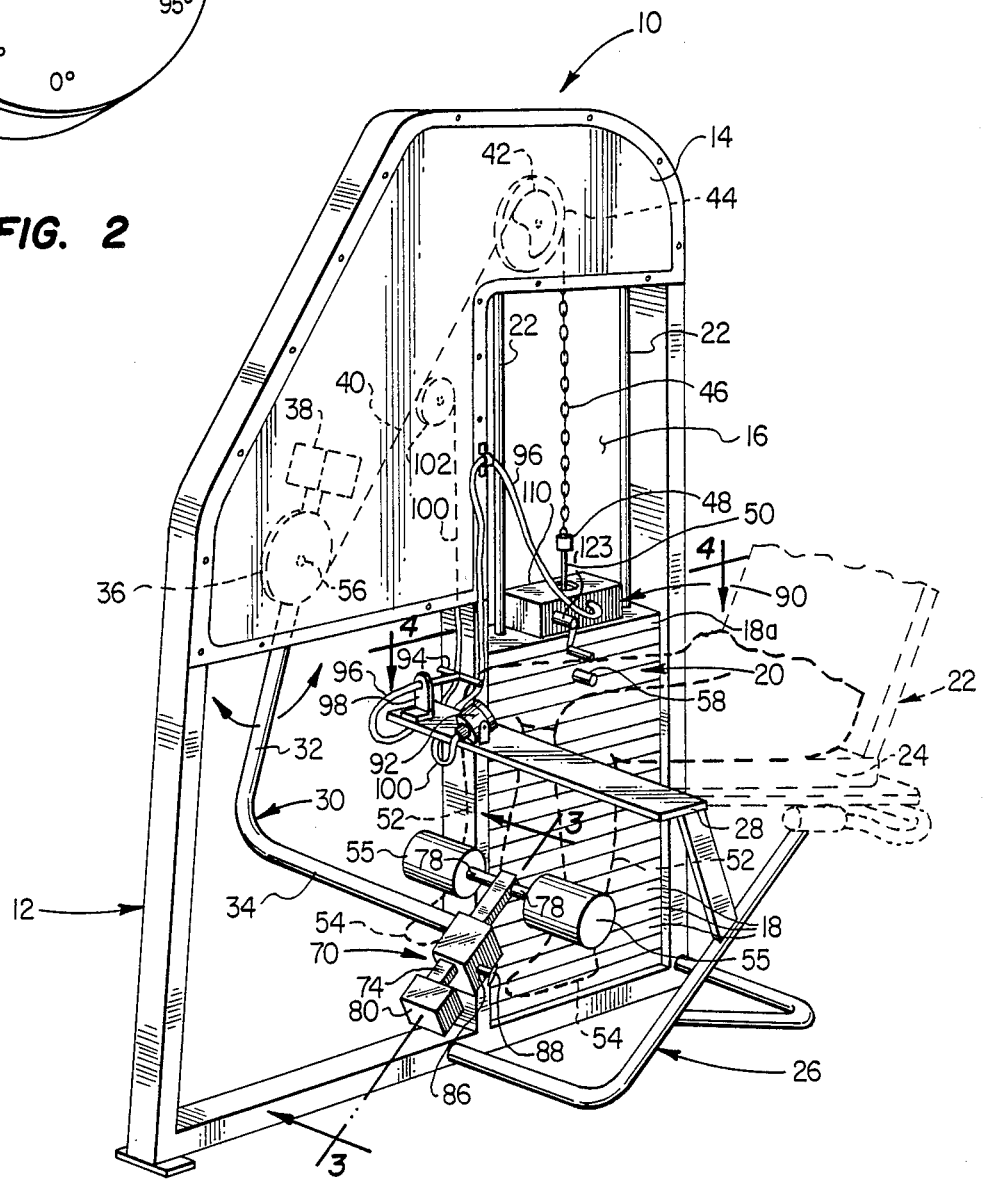
FIG. 1 is a perspective view of a leg extension exercise machine embodying principles of the present invention, portions of the machine being broken away and shown in phantom for illustrative purposes.

Perspectively illustrated in FIG. 1 is a leg extension exercise machine 10 which embodies principles of the present invention and has certain unique features incorporated therein which facilitates its use in rehabilitative leg exercise programs. Machine 10 has a floor supportable, vertically extending support frame structure 12 provided at its upper end with a shroud portion 14 and along its right side with a vertically extending opening 16 within which the individual weights 18 of a weight stack 20 are slidably supported on vertically extending guide rods 22 in the usual manner. Extending outwardly from one side of the support frame structure 12 adjacent the weight stack 20 is an elevated seat structure 22 having a padded seat 24 mounted atop a seat support frame structure 26 having a horizontally extending support member 28 that extends outwardly from the main frame structure 12 beneath a front edge portion of the seat 24.

Positioned forwardly of the seat structure 22 is a generally L-shaped lever member 30 having an upwardly projecting section 32 extending into the shroud 14, and a horizontally outwardly projecting section 34 whose outer end is downwardly and forwardly offset from the front side edge of the seat 24. The upper end of lever section 32 within the shroud 14 is anchored to a sprocket 36 which operatively carries a counterweight 38 and is rotatably supported within the shroud 14. Sprocket 36 is operatively connected to one end of a chain 40 whose other end is wrapped around and anchored to a cam member 42 which is rotatably mounted within the shroud 14 above the frame opening 16 and is secured to a sprocket 44. The upper end of a chain 46 is operatively connected to sprocket 44, the chain 46 extending downwardly through an upper portion of the frame opening 16 and secured at its lower end 48 to an end portion of a flexible strap member 50. In a manner subsequently described, the strap member 50 is secured to the weight stack 20.

To use the leg extension exerciser machine 10, an exerciser sits in the seat 24 with his legs 52 hanging over the front edge of the seat 24. The exerciser hooks his feet 54 under a pair of cylindrical, padded foot engagement members 55, which are anchored to the outer end of the lever section 34 in a manner subsequently described, and then extends his legs toward a straightened position thereof. This extension of the exerciser's legs 52 pivots the lever 30, the sprocket 36 and the counterweight 38 in a clockwise direction about the sprocket pivot point 56. Clockwise rotation of the sprocket 36, via the chain 40, rotates the cam member 42 and the sprocket 44 in a counterclockwise direction to thereby lift a predetermined number of the weight elements 18 via the chain 46 and the strap 50. The number of weight elements 18 lifted in this manner may be selectively varied in a conventional fashion by inserting a retaining pin member 58 into a selected side opening 60 (FIG. 5) formed in each of the weight elements 18 and into a weight carrying rod 62 slidably received in aligned circular openings 64 formed through the weight elements 18. The lifting in this manner of a predetermined number of the individual weight elements 18 imposes a pivotal resistance force on the lever 30 which exercises and strengthens the quadricep muscles in the exerciser's legs 52. When the legs are extended to a desired degree they are slowly lowered to their starting position against the counterclockwise torque maintained on the lever 30 by the predetermined portion of the weight stack 20 as it is being lowered.

Figures 3, 3A, 3B:
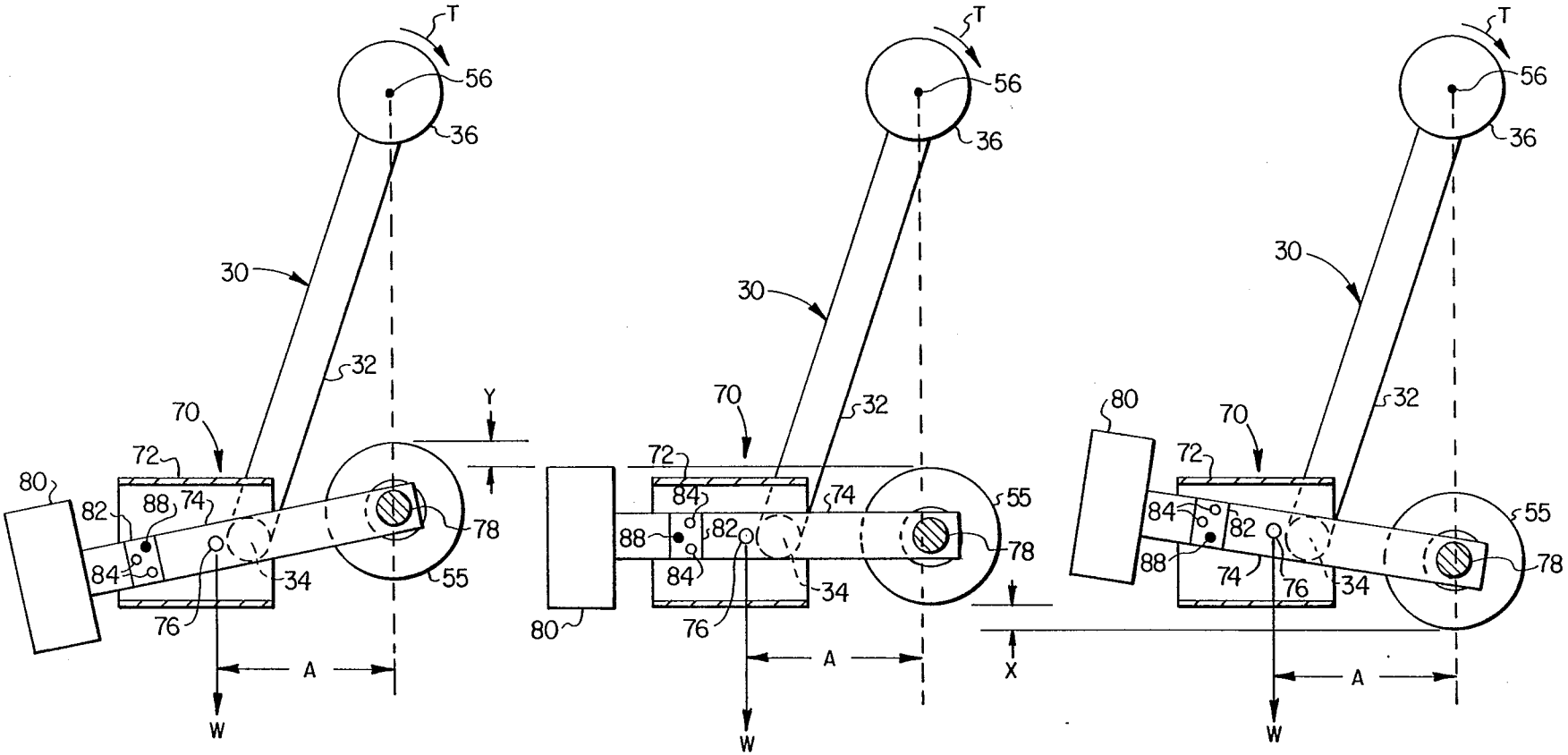
FIGS. 3–3B are enlarged scale cross-sectional views through a leg length adjustment portion of the machine, taken along line 3–3 of FIG. 1, and sequentially illustrate the height adjustment of a foot engagement portion thereof.

Referring now to FIGS. 1 and 3–3B, the present invention provides a unique leg length adjustment structure 70 which permits the height of the foot engagement members 55 to be selectively varied relative to the lever section 34, thereby compensating for exerciser leg length variance, without appreciably altering the rotational balance of the lever member 30 about sprocket 36 provided by the counterweight 38.

The adjustment structure 70 includes a hollow, rectangularly cross-sectioned, open-ended housing 72 which is anchored adjacent its rear or right end to the outer end of the lever section 34 as best illustrated in FIGS. 3–3B. Extending through the interior of the housing 72 is an elongated, rectangularly cross-sectioned support member 74 which is secured within the housing for pivotal motion relative thereto about a horizontal axis by means of a pivot pin 76 forwardly adjacent the lever section 34. The foot engagement members 55 are journaled on the outer ends of a pair of cylindrical connection members 78 which are anchored at their inner ends to the right end of the support members 74. A counterweight member 80 is secured to the left or outer end of the support member 74 and is sized to counterbalance the clockwise torque on the support member 74 exerted by the foot engagement members 55 and their connecting structure. Accordingly, as illustrated in FIGS. 3–3B, the center of gravity of the overall foot engagement structure defined by interconnected support member 74, the foot engagement members 55, the connecting members 78, the counterweight 80, and a subsequently described plate 82, is located at the pivot pin 76 so that the total weight W of such foot engagement structure passes downwardly therethrough.

The pivotal orientation of the support member 74 relative to the housing 72 may be selectively varied among three separate positions by means of the small locking plate member 82 secured to one side of the support member 74 within the housing 72 and leftwardly of the pivot pin 76. Locking plate 82 has formed therein three small circular openings 84 arranged in an arcuate path centered about the pivot pin 76. By appropriately pivoting the support member 74 about the pin 76, a selected one of these three plate openings 84 may be brought into registry with a circular side wall opening 86 (FIG. 1) formed in the housing 72. A spring loaded retaining pin 88 is operatively supported on the housing 72 and may be releasably inserted into the plate opening 84 which is brought into registry with the housing side wall opening 86.

In its position depicted in FIG. 3, the support member 74 is pivoted in a counterclockwise direction to bring the uppermost plate opening 84 into registry with the housing sidewall opening 86 so that the retaining pin 88 is received within the uppermost plate opening 84. This raises the foot engagement members 55 to their highest position relative to the housing 72 to accommodate a relatively short leg. With the support member 74 in this position, the weight W of the foot engagement structure exerts a counterclockwise torque on the lever section 32 equal to $W \times A$, wherein A is equal to the horizontal distance between the sprocket pivot point 56 and the pivot pin 76. A counterbalancing clockwise torque T is exerted on the lever section 32 about the sprocket pivot point 56 by the counterweight 38 (FIG. 1), such counterbalancing torque T being equal to $W \times A$ whereby the lever member 30 is rotationally balanced about the sprocket pivot point 56 in the absence of leg forces on the foot engagement members 55 and weight stack forces on the chain 40.

In FIG. 3A the support member 74 has been moved to its pivotally intermediate orientation relative to the housing 72 by removing the retaining pin 88 from the uppermost plate opening 84, pivoting the support member 74 in a clockwise direction to bring the central plate opening 84 into registry with the housing opening 86, and then inserting the retaining pin 88 into the intermediate plate opening 84 to thereby lock the support member in a generally horizontal orientation. As can be seen by comparing FIGS. 3 and 3A, this pivotal adjustment of the foot engagement structure lowers the foot engagement members 55 by a distance Y relative to the housing 72 to thereby accommodate somewhat longer exerciser legs such that the feet of the longer legs will engage the foot engagement members 55 in substantially the same orientation as the feet of the somewhat shorter legs would engage the members 55 when the support member 74 is pivoted to its orientation depicted in FIG. 3.

Importantly, this pivotal height adjustment of the foot engagement members 55 does not shift the overall center of gravity of the foot engagement structure horizontally relative to the pivot point 56 of sprocket 36. Thus, the clockwise counterweight torque T on the sprocket 36 is still rather precisely balanced by the counterclockwise torque WA. Accordingly, a leg length (or foot height) adjustment has been effected without affecting the rotational balance of the lever member 30 about the sprocket pivot point 56.

In a similar fashion, as depicted in FIG. 3B, the foot engagement members 55 may be adjusted to their lowest position simply by releasing the retaining pin 88, pivoting the support member 74 in a clockwise direction from its horizontal position in FIG. 3A to bring the bottom plate opening 84 into registry with the housing opening 86, and then inserting the retaining pin 88 into the bottom plate opening 84 to pivotally lock the support member 74 in its orientation shown in FIG. 3B. As may be seen by comparing FIGS. 3A and 3B, this further lowers the foot engagement members 55 by a distance X to thereby accommodate still longer exerciser legs and permit their feet to operatively engage the members 55 as previously described in conjunction with FIGS. 3 and 3A. Again, the center of gravity of the overall foot engagement structure has not been horizontally shifted relative to the sprocket pivot point 56 and the counterweight sprocket torque T is still balanced by the oppositely directed foot engagement structure torque WA.

The ability to adjust the operating height of the foot engagement members 55 without altering the rotational balance of the lever member 30 about the sprocket pivot point 56 is particularly useful for exercisers engaged in rehabilitative leg exercise programs—for example, following knee surgery - and thus confined to utilizing only a very small portion of the total weight available in the weight stack 20.

For example, if only the uppermost weight element 18a is being utilized, it can be seen that the overall rotational balance of the lever member 30 about the sprocket pivot point 56 becomes far more critical relative to the total leg force which must be imposed upon the foot engagement members 55 than if a much larger portion of the weight stack 20 was being lifted. In conventional leg length adjustment mechanisms, the positional adjustment of the foot engagement members 55 unavoidably shifts the center of gravity of the foot engagement structure horizontally relative to the sprocket axis 56, thereby altering the rotational balance of the lever member 30 about sprocket axis 56 and rendering the use of the machine less desirable for users involved in rehabilitative leg exercise programs. As just described, however, the exercise machine 10 uniquely avoids these resulting foot engagement imbalance problems via the leg length adjustment structure 70.

Figure 2:
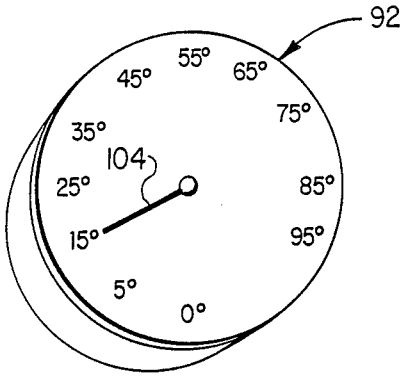
FIG. 2 is an enlarged scale perspective view of an angular position indicating gauge portion of the machine.

The operation of the machine 10 by users engaged in rehabilitative leg exercise programs is further facilitated by the provision of a unique exercise motion range limiting and observation system which includes an angular start position adjustment mechanism 90 (FIGS. 1, 4 and 5) and a lever member angular position indicating gauge 92 (FIGS. 1 and 2). The usefulness of this system arises in rehabilitative or other situations in which the exerciser must limit the weight stackresisted movement of his legs to a prescribed angular range less than the total angular range available in the lever member 30. For purposes of illustration it will be assumed that following reconstructive knee surgery or the like the exerciser has been advised by his doctor that, in using machine 10, the legs should be flexed against the resistance of a prescribed portion of weight stack 20 only through an angular range of the lever member 30° of from 15° (the normal at rest "start" position of lever member 30 being at 0° ) to 55° .

To set the start position of this limited weightresisted angular range, the exerciser appropriately adjusts the height of the foot engagement members 55 as previously described, sits in the seat 24 and engages his feet 54 with the height adjusted members 55. He then pulls the T-handle 94 (FIG. 1) of a push-pull cable 96 supported at its outer end by a bracket 98 on the inner end of seat support member 28. In a manner subsequently described, this permits the strap 50 to be pulled upwardly by chain 46 without lifting any portion of the weight stack 20.

With the weight stack 20 in effect disconnected from chain 46 in this manner, the exerciser extends his legs 52 to pivot lever member 30 in a clockwise direction about sprocket pivot point 56—a pivotal motion now wholly unimpeded by any portion of the weight stack 20. Gauge 92 is operatively connected, via a cable 100, to a small sprocket 102 rotatably supported within the shroud 14 and operatively engaged by the chain 40. Clockwise pivotal motion of the lever member 30 from its 0° start position causes the chain 40 to rotate sprocket 102, thereby rotating the indicator needle 104 of gauge 92 (FIG. 2) to provide the exerciser with a visual indication of the angle through which the lever member 30 has been pivoted relative to its normal 0° start position.

When the lever member has been freely pivoted (i.e., without weight stack resistance) to an angle of 15° as indicated on the gauge 92, the exerciser holds the lever member 30 at this 15° start position and pushes the cable T-handle 94 inwardly to re-engage the strap 50 with the selected portion of the weight stack 20 in a manner subsequently described. Further clockwise pivoting of the lever member 30 by the exerciser's legs as they are being pivoted further toward their fully extended positions, is then resisted by the predetermined weight stack portion in a conventional manner.

During this further clockwise pivotal motion of the lever member 30, the gauge 92 provides a continuous visual indication of the actual angular position of the lever member. Accordingly, when the gauge needle 104 reaches the 55° mark on the gauge, the exerciser simply terminates the extension of his legs and allows them to slowly flex back toward their starting position. When the lever member 30 is returned to its 15° position, slack is automatically introduced into the strap 50 to thereby terminate any weight stack-caused counterclockwise torque on the lever member 30 as it is moved from its 15° adjusted start position toward its normal 0° start position. In this manner, the lower end of the prescribed weight stack-resisted angular leg exercise range is automatically established and maintaied.

It is important to note that even during the nonresisted portion of the pivotal motion of the lever member 30, the cam member 42 is being rotated by the sprocket 36 and the chain 40. Accordingly, the important relationship between the angular positions of the lever member 30 and the cam member 42 is at all times maintained despite the adjustment as previously described of the effective weight-resisted available angular range of the lever member 30. Stated in another manner, to effect the range adjustment of the machine 10 as just described, it is not necessary to in any manner alter the built-in relationship between the travel of the lever member 30 and the angular position of the cam 42. Additionally, it is not necessary to lift any portion of the weight stack 20 during the initial setting of the effective altered start position of the lever member 30.

Figure 4:
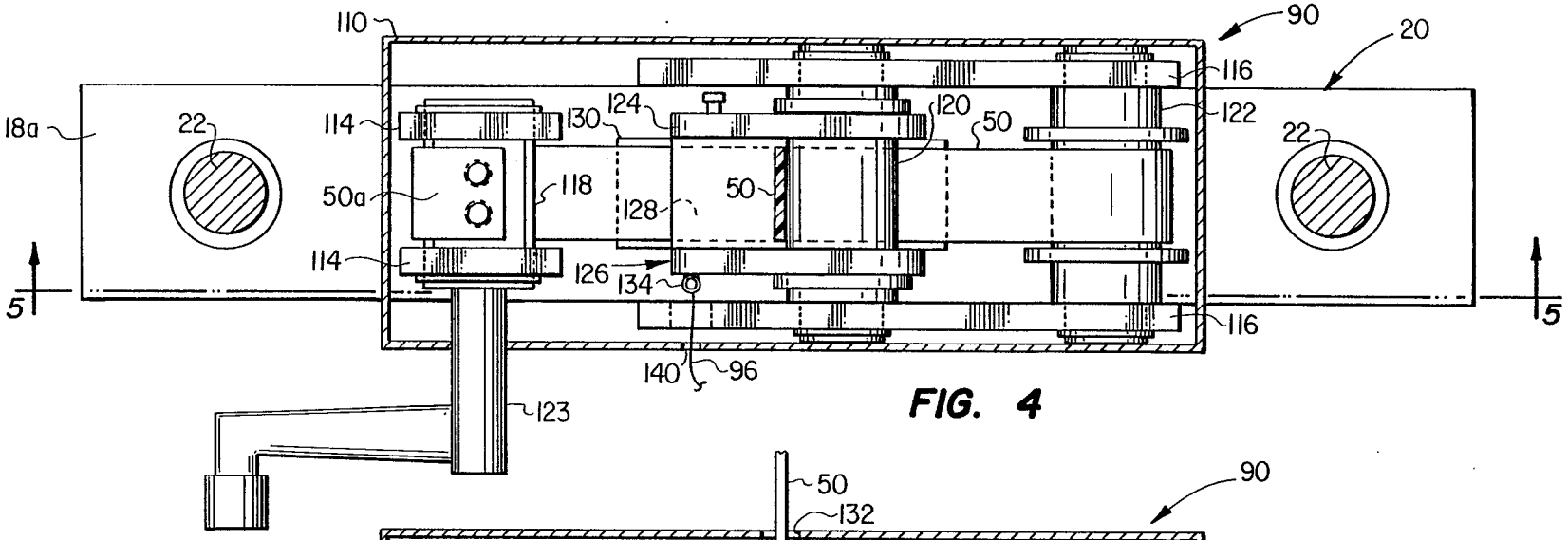
FIG. 4 is an enlarged scale cross-sectional view, taken along line 4—4 of FIG. 1, through a motion range adjustment mechanism used in the machine.
Figure 5:
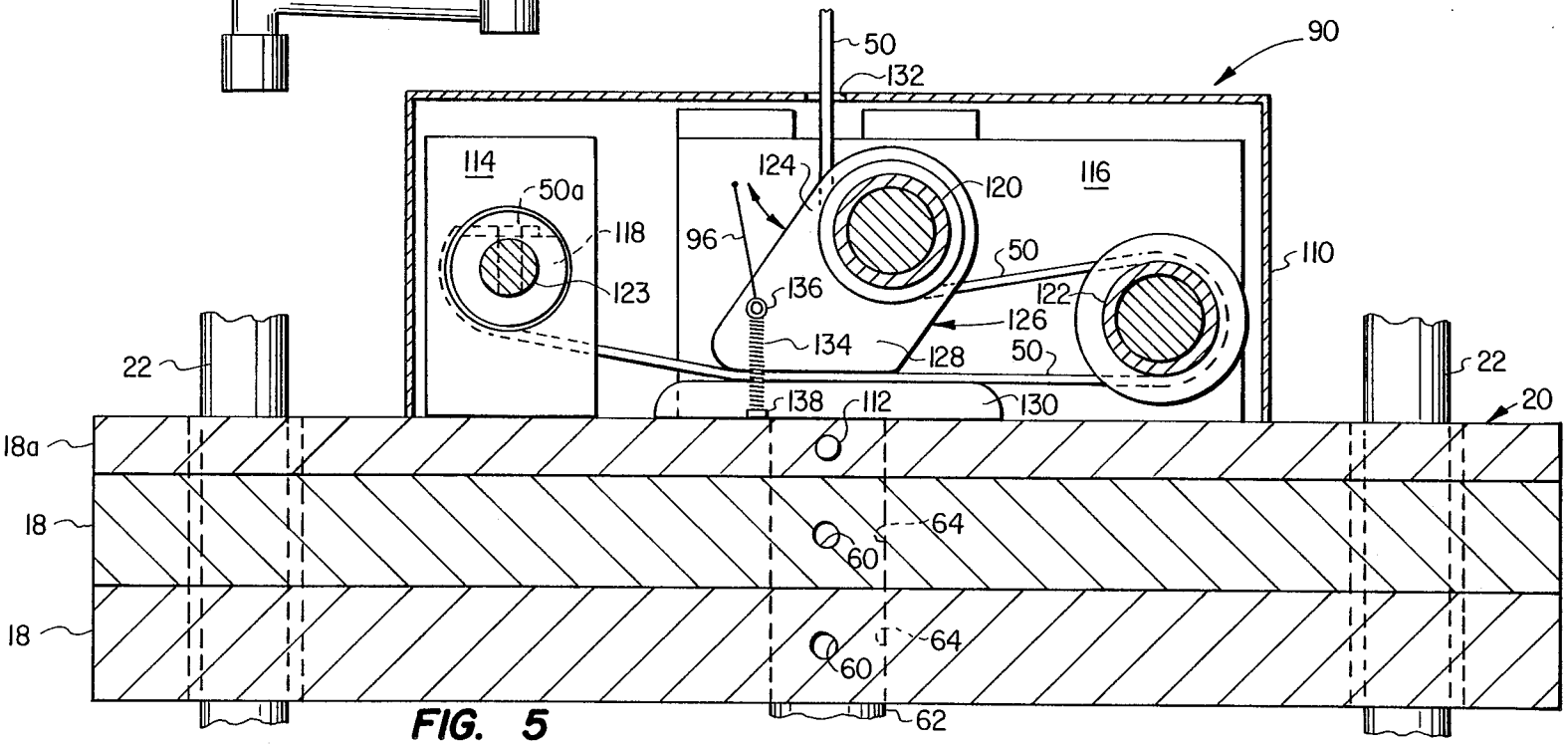
FIG. 5 is a cross-sectional view through the range adjustment mechanism taken along 5—5 of FIG. 4.

Referring now to FIGS. 1, 4 and 5, the structure and operation of the start position adjustment mechanism 90 will be described in detail. Mechanism 90 includes the uppermost weight element $18_a$ which is preferably considerably lighter than the other weight elements 18, and a hollow rectangular housing 110 suitably secured to the upper side surface of the weight element $18_a$ between the guide rods 22. The weight element 18a is permanently secured to the upper end of the weight carrying rod 62 by means of a pin member 112. Positioned within the housing 110 and suitably anchored to the weight element $18_a$ are a spaced pair of vertical support plates 114 adjacent the left end of the housing, and a spaced pair of vertical support plates 116 positioned to the right of the support plates 114. A supply and drive roller 118 is journaled between the plates 114, and a spaced pair of idler rollers 120, 122 are journaled between the plates 116, the roller 120 being generally positioned above the upper end of the weight carrying rod 62. A crank handle 123 carried externally of the housing 110 (see FIG. 1) is operatively anchored to the supply and drive roller 118. The vertically extending arms 124 of a generally U-shaped frictional brake member 126, having a base portion 128, are rotatably carried by the roller 120 in a manner permitting the brake member 126 to be pivoted about roller 120 to move the brake member base portion 128 toward and away from an engagement plate 130 secured to the upper surface of the weight element $18_a$ and positioned beneath the brake member.

From its connection to the lower end 48 of the chain 46 (FIG. 1) the flexible strap 50 is extended downwardly through a suitably sized opening 132 in the upper wall of the housing 110, passed beneath the idler roller 120, wrapped around the idler roller 122, extended through the space between the brake member base 128 and the engagement plate 130, and is suitably anchored at its inner end $50_a$ to the supply and drive roller 118. The brake member 126 is rotationally biased in a counterclockwise direction about the roller 120 by a small tension spring 134 interconnected at its opposite ends 136 and 138 between one of the brake member arms 124 and the weight element $18_a$.

Spring 134 normally biases the brake member base portion 128 into engagement with the portion of strap 50 positioned between the base portion 128 and the engagement plate 130 to thereby pinch such strap portion between the brake member and the engagement plate. This frictionally precludes rightward movement of the strap through the space between the brake member and the engagement plate, but permits leftward strap movement therethrough. The previously described push-pull cable 96 is extended through a small side wall opening 140 in the housing 110 (FIG. 4) and is suitably achored at its inner end (FIG. 5) to one of the brake member arms 124, for example at the connection point of the upper spring end 136 to such arm.

When T-handle 94 of the push-pull cable 96 is pulled as previously described to adjust the effective "start" position of the lever member 30, the brake member 126 is pivoted in a clockwise direction about the idler roller 120 to thereby widen the gap between the brake member base portion 128 and the engagement plate 130 to permit rightward movement of the strap 50 through the widened gap. As the exerciser extends his legs to bring the lever member to the 15° adjusted start position, the outer end of the strap 50 is pulled upwardly causing the roller 118 to be rotated in a counterclockwise direction (as viewed in FIG. 5) to thereby permit a portion of the strap 50 coiled thereon to be pulled through the brake member - engagement plate gap as the chain 46 (FIG. 1) is pulled upwardly.

As can be seen most clearly in FIG. 5, this release of the brake 126 permits the unwinding strap 50 to be pulled upwardly through the housing opening 132, as the chain 46 is being pulled upwardly, without upwardly moving any of the weight elements 18. The release of the brake member 186 thus acts to temporarily disconnect the lever member 30 from the weight 20. The roller 118 is shown in FIG. 5 in its fully unwound position for purposes of illustration. It will be appreciated, however, that with the machine 10 in its normal operating mode (i.e., with the weight stack being operatively carried by the lever member 30 throughout its entire pivotal range) an inner end portion of the strap 50 will be coiled about the roller 118.

When the lever member 30 is moved to its adjusted 15° start position as previously described and as indicated by the gauge 92, the exerciser simply pushes the cable T-handle 94 in to permit the spring 134 to return the brake member 126 to its strap-pinching position depicted in FIG. 5 to preclude further rightward strap movement through the gap between the brake member and the engagement plate. This once more operatively connects the selected portion of the weight stack 20 to the lever member 30 such that further clockwise pivotal movement thereof beyond its 15° start position lifts the selected portion of the weight stack 20 via the once again frictionally locked strap 50. When the lever member 30, on the return stroke thereof, is moved past it 15° adjusted start position (at which point the lifted weight stack portion is returned to its start position) the effectively lengthened strap 50 is simply slackened to thereby again operatively disconnect the selected weight stack portion from the lever member 30.

The slack created in the strap 50 when the lifted weight stack portion is fully lowered may be easily taken up simply by rotating the crank handle 123 in a clockwise direction as viewed in FIG. 5. This pulls the strap 50 leftwardly through the brake member-engagement plate gap and re-wraps an inner end portion of the strap 50 around the supply and drive roller 118. When the strap is re-tightened between the roller 118 and the lower end 48 of the chain 46 (FIG. 1) the weight stack 20 is again operatively connected to the lever member 320 at the angular position of such lever member when the slack is taken out of the strap 50 in this manner.

Accordingly, when the rehabilitative leg exercise routine is completed, the lever member 30 may be returned to its 0° normal start position and the crank handle 123 used to remove the slack in the strap 50 to thereby once again operatively connect the weight stack 20 to the lever member 30 in its normal 0° weight-resisted start position. In a similar fashion, the adjusted start position of lever member 30 may be angularly decreased during the performance of the rehabilitative leg exercise routine. For example, if it is desired to adjust the weight-resisted start position of the lever member from 15° to 10° , the exerciser simply lowers the lever member 30 to 10° , as indicated on the gauge 92, and then rotates the crank handle 123 to take up the strap slack at the 10° lever member position. With this simple and rapid adjustment made, subsequent clockwise pivoting of the lever member 30 is now resisted by the selected portion of weight stack 20 from 10° on.

While the start position adjustment mechanism 90 has been illustrated and described herein as being incorporated in the weight stack of a leg exercise machine, it will be readily appreciated that it could also be incorporated in the weight stacks of a variety of other exercise machines of this general type used to exercise and strengthen other portions of the body. The range adjustment of the force input members of such alternate machines would be effected in the same manner as described above, and a gauge similar to the gauge 92 could be utilized to provide a visual indication of the position in the overall force input member movement range to which such member has been moved during performance of a given exercise routine.

The foregoing detailed description is to be clearly understood as being given by way of illustration and example only, the spirit and scope of the present invention being limited solely by the appended claims.

What is claimed is:

1. An exercise machine comprising:

an input member supported for forcible movement by a portion of an exerciser's body through a maximum exercise motion range extending between a first end position of said input member and a second end position of said input member;

resistance means, operatively connectable to said input member, for providing a yielding resistance to exerciser movement of said input member toward said second end position thereof;

connecting means for operatively connecting said resistance means to said input member, said connecting means having an elongated flexible section with an end portion connectable to said resistance means; and resisted range adjustment means operable to selectively vary the portion of said exercise motion range through which movement of said input member is resisted by said resistance means, said resisted range adjustment means including:

roller means carried by said resistance means and secured to said end portion of said flexible section, said roller means being rotatable in opposite directions to selectively roll up said end portion to tension said flexible section and operatively associate said resistance means and said input member, or to permit payout said end portion relative to said resistance means to permit said input member to be moved from said first end position thereof toward said second end position thereof without resistance from said resistance means, and locking means selectively operable to lock said end portion to said resistance means or to unlock said end portion and permit payout thereof relative to said resistance means, whereby the resisted starting point of said input member within said motion range may be shifted from said first end position to a preselected intermediate position within said motion range by unlocking said locking means with said input member in said first end position to operatively disassociate said input member and said resistance means, moving said input member from said first end position to said intermediate position to cause end portion payout relative to said resistance means, and then re-locking said locking means to operatively reassociate said input member and said resistance means.

2. The exercise machine of claim 1 further comprising:

gauge means for continuously providing a visual readout indicative of the position of said input member wihin said motion range thereof.

3. The exercise machine of claim 1 wherein:

said connecting means include a cam member operably interposed therein for rotation in response to movement of said input member, there being a predetermined, desired relationship between the angular position of said cam member and the position of said input member within said exercise motion range thereof, and said resisted range adjustment means are operative to shift said resisted starting point of said input member within said motion range thereof without appreciably altering said predetermined, desired relationship.

4. The exercise machine of claim 1 wherein:

said exercise machine is a leg extension exercise machine.

5. The exercise machine of claim 1 wherein:

said end portion of said flexible section of said connecting means is a flexible strap member.

6. The exercise machine of claim 5 wherein:

said resistance means comprise a weight stack formed from a series of individual weight elements including an uppermost weight element, said weight stack having means associated therewith for operatively associating a selectively variable number of said weight elements to said flexible section to be lifted thereby when said locking means are locked and said input member is moved toward its second end position, and said roller means are secured to said uppermost weight element for movement therewith.

7. The exercise machine of claim 6 wherein:

said locking means include a brake member supported on said uppermost weight element for movement between a first position in which said brake member frictionally locks said strap against payout and a second position in which said brake member frees said strap for payout, cable means operable to selectively move said brake member between said first and second positions thereof, and spring means for biasing said brake member toward said first position thereof.

8. The exercise machine of claim 7 further comprising:

crank handle means secured to said roller means for selectively rotating them in said opposite directions.

9. A leg extension exercise machine comprising:

a support frame;

an elevated seat structure associated with said support frame and having a seat upon which an exerciser may sit with his legs hanging over a front edge portion thereof;

a leg force input lever member carried by said support frame for leg-driven pivotal motion relative thereto about a generally horizontal axis, said lever member having an outer end portion which, with said lever member in an at rest start position, is positioned forwardly of and lower than said front edge portion of said seat;

foot engagement means pivotally carried by said outer end portion of said lever member and having a foot engagement portion engageable by the legs of the seated exerciser, generally adjacent his feet, in a manner such that extension of the exerciser's legs pivotally drives said lever member in a first rotational direction about said axis, the weight of said foot engagement means passing through a center of gravity thereof and exerting a first torque on said lever member in a second rotational direction about said axis;

counterweight means operatively associated with said lever member for exerting a second torque thereon in said first rotational direction about said axis to rotationally counterbalance said first torque;

resistance means, operatively connected to said lever member, for yieldingly resisting leg-driven pivotal movement of said lever member about said axis; and adjustment means for pivotally adjusting said foot engagement means relative to said outer end portion of said lever member in a manner selectively varying the height of said foot engagement portion relative to said outer end portion to compensate for exerciser leg length variances without shifting said center of gravity relative to said outer end portion, whereby leg length adjustments may be made to said foot engagement means without rotationally imbalancing said lever member about said axis.

10. The exercise machine of claim 9 wherein:

said foot engagement means include an elongated support member, means for securing a longitudinally intermediate portion of said support member to said outer end portion of said lever member for pivotal motion relative thereto about a pivot point, a pair of foot engagement members operatively secured to one end of said support member and defining said foot engagement portion, a counterweight member secured to the opposite end of said support member and sized to rotationally balance said support member about said pivot point, and means for releasably locking said support member in a selected one of a plurality of pivotal orientations relative to said outer end portion of said lever member.

11. The exercise machine of claim 10 wherein:

said means for securing include a hollow, open-ended housing anchored to said outer end portion of said lever member and circumscribing said longitudinally intermediate portion of said support member, and pivot pin means anchored at opposite ends to facing interior portions of said housing and extending through said longitudinally intermediate portion of said support member, and said means for releasably locking include an opening formed through a side wall portion of said housing, a locking member carried by said longitudinally intermediate portion of said support member and having a plurality of openings formed therein which may each be brought into registry with said housing opening by pivoting said support member, and pin means insertable through said housing opening into the selected locking member opening in registry therewith.

12. A leg extension exercise machine comprising:

a support frame;

an elevated seat structure associated with said support frame and having a seat upon which an exerciser may sit with his legs hanging over a front edge portion thereof;

a leg force input lever member carried by said support frame for leg-driven pivotal motion relative thereto about a generally horizontal axis through a maximum pivotal exercise motion range extending between a first end position of said lever member and a second end position thereof, said lever member having an outer end portion which, with said lever member in an at rest start position, is positioned forwardly of and lower than said front edge portion of said seat;

foot engagement means pivotally carried by said outer end portion of said lever member and having a foot engagement portion engageable by the legs of the seated exerciser, generally adjacent his feet, in a manner such that extension of the exerciser's legs pivotally drives said lever member in a first rotational direction about said axis, the weight of said foot engagement means passing through a center of gravity thereof and exerting a first torque on said lever member in a second rotational direction about said axis;

counterweight means operatively associated with said lever member for exerting a second torque thereon in said first rotational direction about said axis to rotationally counterbalance said first torque;

resistance means operatively connectable to said lever member, for providing a yielding resistance to exerciser movement of said lever member toward said second end position thereof;

connecting means for operatively connecting said resistance means to said lever member, said connecting means having an elongated flexible section with an end portion connectable to said resistance means;

leg length adjustment means for pivotally adjusting said foot engagement means relative to said outer end portion of said lever member in a manner selectively varying the height of said foot engagement portion relative to said outer end portion to compensate for exerciser leg length variances without shifting said center of gravity relative to said outer end portion, whereby leg length adjustments may be made to said foot engagement means without rotationally imbalancing said lever member about said axis;

gauge means for continuously providing a visual readout indicative of the pivotal position of said lever member within said motion range thereof; and resisted range adjustment means operable to selectively vary the portion of said exercise motion range through which movement of said lever member is resisted by said resistance means, said resisted range adjustment means including:

roller means carried by said resistance means and secured to said end portion of said flexible section, said roller means being rotatable in opposite directions to selectively roll up said end portion to tension said flexible section and operatively associate said resistance means and said input member, or to pay out said end portion relative to said resistance means to permit said input member to be moved from said first end position thereof toward said second end position thereof without resistance from said resistance means, and locking means selectively operable to lock said end portion to said resistance means or to unlock said end portion and permit payout thereof relative to said resistance means, whereby the resisted starting point of said lever member within said motion range may be shifted from said first end position to a preselected intermediate position within said motion range by unlocking said locking means with said input member in said first end position to operatively disassociate said input member and said resistance means, pivoting said lever member from said first end position to said intermediate position to cause end portion payout relative to said resistance means, and then re-locking said locking means to operatively reassociate said lever member and said resistance means.

* * * * *